US009649522B2

(12) United States Patent
Wyatt et al.

(10) Patent No.: US 9,649,522 B2
(45) Date of Patent: May 16, 2017

(54) MULTI-FUNCTIONAL EXERCISE APPARATUS

(71) Applicants: Maurice Wyatt, Denver, CO (US); Darlene Wyatt, Denver, CO (US)

(72) Inventors: Maurice Wyatt, Denver, CO (US); Darlene Wyatt, Denver, CO (US)

( * ) Notice: Subject to any disclaimer, the term of this patent is extended or adjusted under 35 U.S.C. 154(b) by 382 days.

(21) Appl. No.: 13/777,699

(22) Filed: Feb. 26, 2013

(65) Prior Publication Data

US 2013/0231228 A1 Sep. 5, 2013

Related U.S. Application Data

(60) Provisional application No. 61/606,303, filed on Mar. 2, 2012.

(51) Int. Cl.
*A63B 21/02* (2006.01)
*A63B 21/04* (2006.01)
(Continued)

(52) U.S. Cl.
CPC .... *A63B 21/0442* (2013.01); *A63B 21/00043* (2013.01); *A63B 21/00065* (2013.01);
(Continued)

(58) Field of Classification Search
CPC ..... A63B 2210/50; A63B 21/0557; A63B 21/00061; A63B 21/16; A63B 21/153; A63B 21/156; A63B 21/02; A63B 21/04; A63B 21/0407; A63B 21/0414; A63B 21/0421; A63B 21/0428; A63B 21/0435; A63B 21/0442; A63B 21/05; A63B 21/055; A63B 21/0552; A63B 21/0555;
(Continued)

(56) References Cited

U.S. PATENT DOCUMENTS 481,730 A * 8/1892 Miller ..... 482/127
679,784 A * 8/1901 Ryan ..... 482/129
(Continued)

FOREIGN PATENT DOCUMENTS

GB 307116 A * 3/1929
WO WO 2008011544 A2 * 1/2008

OTHER PUBLICATIONS

Perez, Oscar, "Resistance Band Exercise Station", U.S. Appl. No. 61/316,723, Mar. 23, 2010, 43 pp.
(Continued)

*Primary Examiner* — Joshua Lee
(74) *Attorney, Agent, or Firm* — Trenner Law Firm, LLC; Mark D. Trenner

(57) ABSTRACT

An exercise apparatus includes an upper assembly and a lower assembly for coupling with the upper assembly. A plurality of engaging channels are provided at an inner surface of the lower assembly at a variety of orientations. A plurality of resistance media are provided with the exercise apparatus in configurations enabling selective coupling with the engaging channels. In a method of using the exercise apparatus, a user couples one or more of the plurality of exercise media with the engaging channels, performs at least one first exercise by pulling the coupled exercise media from a contracted position to a stretched position and changes the orientation of the exercise media to perform at least one second exercise.

20 Claims, 18 Drawing Sheets

(51) Int. Cl.

| | |
|---|---|
| ***A63B 21/00*** | (2006.01) |
| ***A63B 71/00*** | (2006.01) |
| ***A63B 21/055*** | (2006.01) |
| ***A63B 23/035*** | (2006.01) |
| ***A63B 23/04*** | (2006.01) |
| ***A63B 23/12*** | (2006.01) |
| *A63B 71/02* | (2006.01) |

(52) U.S. Cl.
CPC ..... *A63B 21/0552* (2013.01); *A63B 21/4009* (2015.10); *A63B 21/4015* (2015.10); *A63B 21/4025* (2015.10); *A63B 23/0355* (2013.01); *A63B 23/03541* (2013.01); *A63B 23/0458* (2013.01); *A63B 23/1209* (2013.01); *A63B 71/0036* (2013.01); *A63B 21/0557* (2013.01); *A63B 23/0494* (2013.01); *A63B 2071/027* (2013.01); *A63B 2208/0204* (2013.01); *A63B 2208/0214* (2013.01); *A63B 2208/0233* (2013.01); *A63B 2210/50* (2013.01)

(58) Field of Classification Search
CPC ..... A63B 2210/00; A63B 2210/58; A63B 2225/10; A63B 2225/102; A63B 2225/105; A63B 2225/107
USPC ..... 482/121–130
See application file for complete search history.

(56) References Cited

U.S. PATENT DOCUMENTS 754,992 A * 3/1904 Grabner ..... 482/129
760,374 A * 5/1904 Belvoir ..... 482/129
841,227 A * 1/1907 Chellis ..... 482/129
972,284 A * 10/1910 Storey ..... 482/129
1,610,324 A * 12/1926 Roche et al. ..... 482/129
1,715,870 A * 6/1929 Spain ..... A63B 21/0552 482/72
3,664,666 A * 5/1972 Lloyd ..... A63B 17/00 482/121
3,815,904 A * 6/1974 Weiss ..... A63B 21/0004 482/123
3,893,667 A 7/1975 Snyder, Jr. et al.
5,230,676 A * 7/1993 Terauds ..... A63B 23/1209 482/53
5,261,864 A * 11/1993 Fitzpatrick ..... A63B 21/0552 482/123
5,330,399 A * 7/1994 Fan ..... 482/34
5,431,617 A * 7/1995 Rattray, Jr. ..... 482/129
5,551,934 A * 9/1996 Binette ..... A63B 21/4037 482/123
5,618,249 A * 4/1997 Marshall ..... 482/127
5,658,222 A * 8/1997 Brown ..... A63B 21/0552 482/51
5,665,040 A 9/1997 Ho
5,813,953 A * 9/1998 Whipple ..... 482/123
5,839,991 A * 11/1998 Hall ..... 482/23
5,885,196 A 3/1999 Gvoich
5,901,668 A 5/1999 Goodger, Sr.
6,093,136 A 7/2000 Whipple
6,110,083 A * 8/2000 Riser ..... A63B 21/154 482/142
6,348,026 B1 * 2/2002 Kuo ..... A63B 21/0552 482/121
6,500,104 B1 12/2002 Rich
6,500,105 B1 * 12/2002 Kuo ..... 482/123
D482,748 S 11/2003 Flynt
6,648,804 B2 * 11/2003 Chen ..... A63B 21/0004 482/125
6,676,576 B1 1/2004 Wu
6,923,750 B1 8/2005 Hinds
7,001,315 B1 * 2/2006 Diodati ..... A63B 21/0552 482/104
7,093,329 B1 * 8/2006 Chiu ..... A63B 21/0552 24/300
7,250,021 B2 * 7/2007 Leight ..... 482/116
7,377,886 B2 5/2008 Wu
7,591,763 B1 * 9/2009 Fucci ..... A63B 21/4029 482/121
D610,638 S 2/2010 Friess et al.
7,935,036 B2 5/2011 Haynes
7,942,793 B2 * 5/2011 Mills et al. ..... 482/130
7,946,969 B1 * 5/2011 Friess et al. ..... 482/123
7,967,728 B2 6/2011 Zavadsky et al.
8,020,713 B2 * 9/2011 Crincoli et al. ..... 211/85.7
8,038,586 B2 * 10/2011 Blissett ..... 482/124
8,152,703 B1 * 4/2012 Hinds et al. ..... 482/122
8,273,001 B2 9/2012 Karecki
8,287,434 B2 10/2012 Zavadsky et al.
8,702,570 B1 * 4/2014 DelPriore ..... A63B 21/4049 482/123
8,715,144 B1 * 5/2014 Friess ..... A63B 21/4033 482/121
2003/0153441 A1 * 8/2003 Berns et al. ..... 482/128
2004/0102294 A1 * 5/2004 Chen ..... 482/123
2005/0101455 A1 5/2005 Chen
2005/0107226 A1 * 5/2005 Monda ..... 482/121
2006/0058166 A1 * 3/2006 Normandia ..... 482/121
2006/0128540 A1 * 6/2006 Engle ..... 482/123
2006/0194679 A1 * 8/2006 Hatcher ..... 482/123
2007/0087920 A1 * 4/2007 Dachraoui et al. ..... 482/123
2007/0117693 A1 5/2007 Ilioi
2008/0119338 A1 * 5/2008 Prsala ..... A63B 23/1209 482/142
2008/0318743 A1 * 12/2008 Bizzell et al. ..... 482/142
2010/0204023 A1 8/2010 Mills et al.
2010/0255966 A1 * 10/2010 Aucamp ..... A63B 21/0552 482/131
2011/0124473 A1 * 5/2011 Kole et al. ..... 482/79
2011/0143892 A1 6/2011 Karecki
2011/0237410 A1 9/2011 Perez
2011/0251021 A1 10/2011 Zavadsky et al.
2012/0115692 A1 * 5/2012 Bussen et al. ..... 482/130
2012/0244997 A1 * 9/2012 Thompson ..... 482/27
2012/0322636 A1 * 12/2012 Palmer ..... 482/140
2013/0065680 A1 3/2013 Zavadsky et al.
2013/0072361 A1 * 3/2013 Ellis ..... A63B 21/0442 482/129
2013/0079203 A1 * 3/2013 Jones ..... A63B 5/16 482/130
2013/0090216 A1 * 4/2013 Jackson ..... A63B 21/018 482/52
2013/0130873 A1 * 5/2013 Piga ..... B65D 85/70 482/123

OTHER PUBLICATIONS

Zavadsky, Vyacheslav, et al. "Wireless Game Controller for Muscle Training and Physiotherapy", U.S. Appl. No. 61/346,865, May 20, 2010, 35 pp.
Zavadsky, Vyacheslav, et al. "Wireless Video Game Controller Providing Variable Resistance for Physical Exercise", U.S. Appl. No. 61/115,082, Nov. 16, 2008, 8 pp.

* cited by examiner

MULTI-FUNCTIONAL EXERCISE APPARATUS

PRIORITY CLAIM

This application claims the benefit of provisional patent application No. 61/606,303 titled "Resistance based multi-functional exercise station" filed Mar. 2, 2012, hereby incorporated by reference as though fully set forth herein.

BACKGROUND

Research shows that physical inactivity is a fast growing public health problem in many countries and contributes to a variety of chronic diseases and health complications, including obesity, coronary artery disease, diabetes, high blood pressure, cancer, depression and anxiety, arthritis and osteoporosis. In addition to improving a patient's overall health, increasing physical activity as little as 10-15 minutes a day has proven effective in the treatment and prevention of chronic disease. Studies indicate that physical activity need not be strenuous to be beneficial. Regular physical activity improves strength, builds lean muscle, decreases body fat, and can build stronger bones to last a lifetime. The Surgeon General's Report on Physical Activity and Health documented research that indicated men and women of all ages and abilities can improve their quality of life through regular moderate physical activity.

Despite the numerous studies and recommendations by both public and private sector organizations there are numerous reasons why individuals do not incorporate regular exercise regiments into their daily lives. Gymnasiums and fitness centers, while offering a wide array of exercise equipment and customized exercise regiments designed to fit individual needs, are often too expensive for those on a tight budget or intimidating and uncomfortable for those self-conscious about working out in front of others. While there are a myriad of home based exercise devices on the market today many of them go unused. For one reason or another, these devices either lack certain desirable features or they take individuals away from their daily routines.

DETAILED DESCRIPTION

An exercise apparatus is disclosed as it relates to portable exercise devices including resistance bands or tension springs and methods of use. In today's society time has become a luxury, taking the time to create a daily exercise regimen, in many cases, is not feasible. Considering time as a luxury, there are many times during the average day that individuals have what may be considered as idle time and with the proper exercise device they could use that time effectively. Weight bearing exercise systems, in many cases, are too expensive, too bulky to accommodate economical storage and may pose definitive health risk even for experienced users.

Resistance bands and similar resistance media such as the exercise solution discussed herein may be used by individuals of any skill level, personal trainers, physical therapists, and other exercise enthusiasts because of the simple, low-cost design, portability and broad range of fitness and therapeutic applications. The resistance media offers a user the ability to accomplish strength training by building muscle or maintaining muscle tone without many of the risk associated with weight bearing devices.

Example resistance media used for exercising are comprised of circular, closed-ended loops of latex; others are linear and include metal or plastic connectors for attachment of secure handles or straps during use. In other examples, tension springs of various lengths and thicknesses may also be used to simulate weight-bearing exercises. The example resistance media may also offer customized features without having to be attached to door knobs or to be mounted to walls to accommodate various exercise positions.

While a novel exercise apparatus is demonstrated by a description of various examples, and while these examples are described in considerable detail herein, it is not the intention of the applicant to restrict, or, in any way limit the scope to such detail unless otherwise recited in the claims. A novel exercise apparatus, in its broader aspects, is therefore not limited to specific details or illustrative examples shown and described. Accordingly, departures may be made from such details without departing from the spirit or scope of the claims.

Before continuing, it is noted that as used herein, the terms "includes" and "including" mean, but is not limited to, "includes" or "including" and "includes at least" or "including at least." The term "based on" means "based on" and "based at least in part on."

Figure 1:
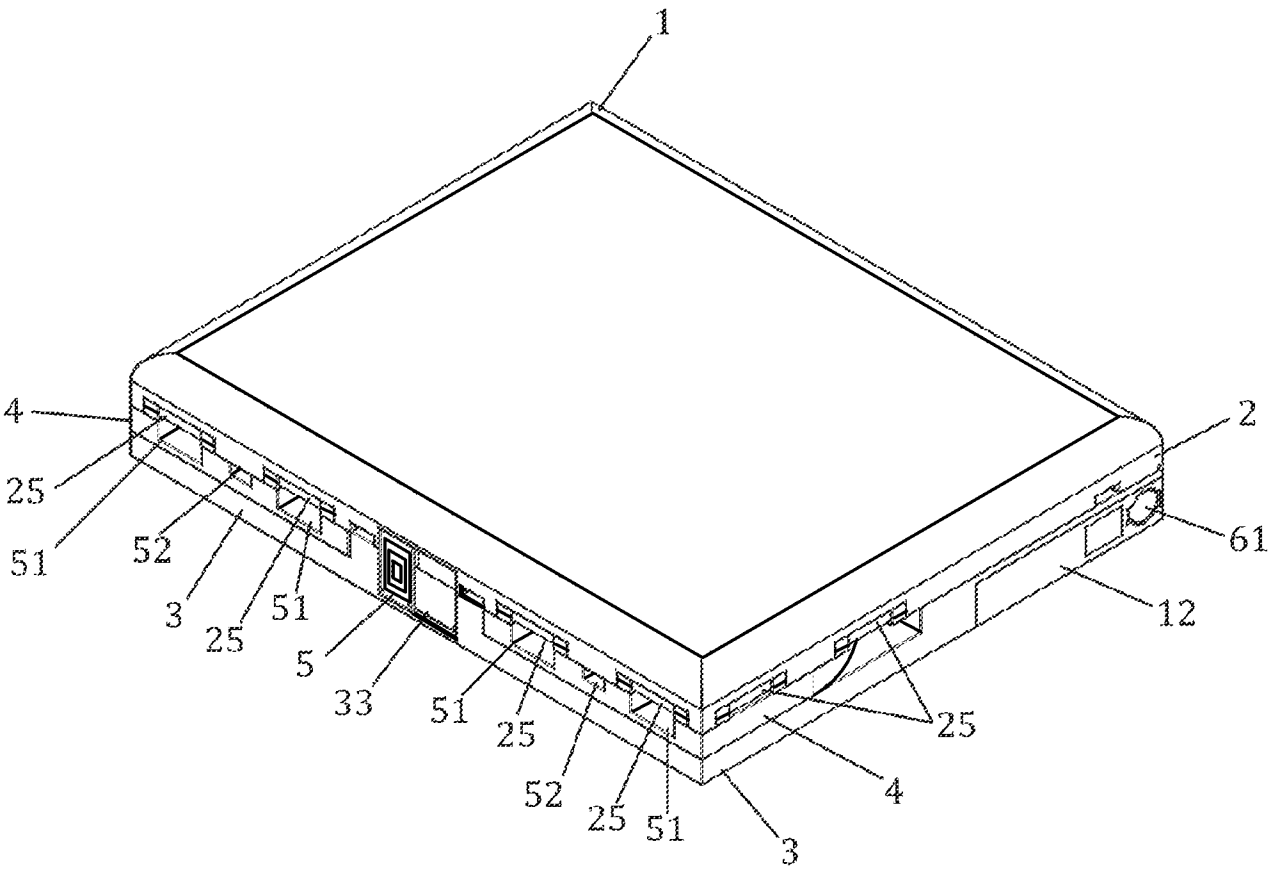
FIG. 1 illustrates an isometric view of an example closed, locked exercise apparatus.
Figure 2:
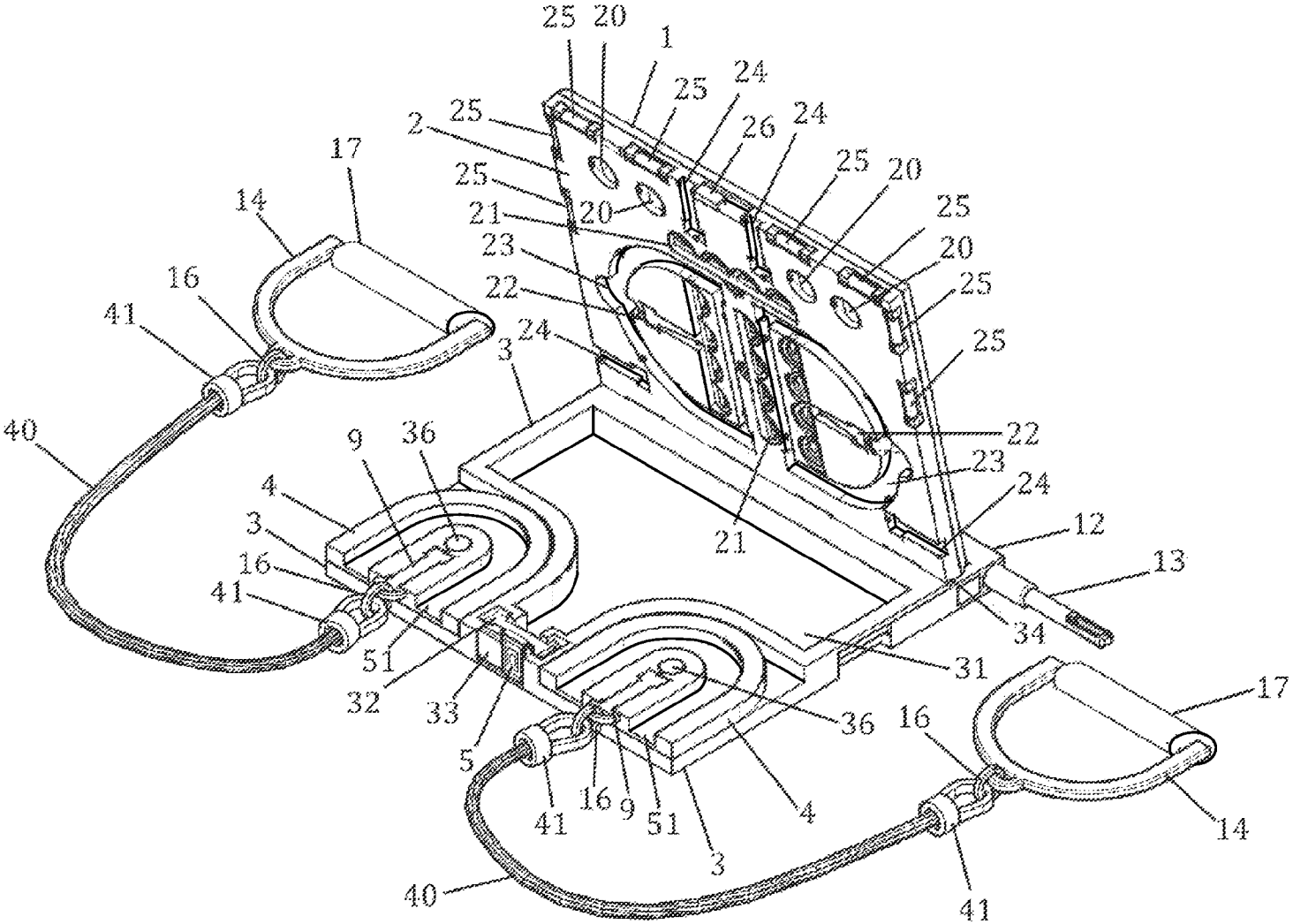
FIG. 2 illustrates an isometric view of an example open exercise apparatus with connected accessory devices.

As illustrated in FIG. 1-2, an example of an exercise apparatus is shown as it may include a multi-functional upper assembly 2 and a multi-functional lower assembly 3. Upper assembly 2 and lower assembly 3 may be made of a light weight, high strength plastic, or any of a variety of materials with similar characteristics including but not limited to metal, metal alloys or wood. In an example, upper 2 and lower 3 assemblies may be rectangular however any of a variety of shapes may be provided.

A cushion top 1 may be applied to an outer surface of upper assembly 2 (e.g., either removably or permanently). Cushion top 1 may be formed from any of a variety of materials including but not limited to dense rubber, foam or padded upholstery. When provided, cushion top 1 may reduce impact on the user while sitting, kneeling or standing on the exercise apparatus. Cushion top 1 is not limited to the shape depicted and may be provided in any of a variety of shapes capable of reducing impact to the user.

Figure 3:
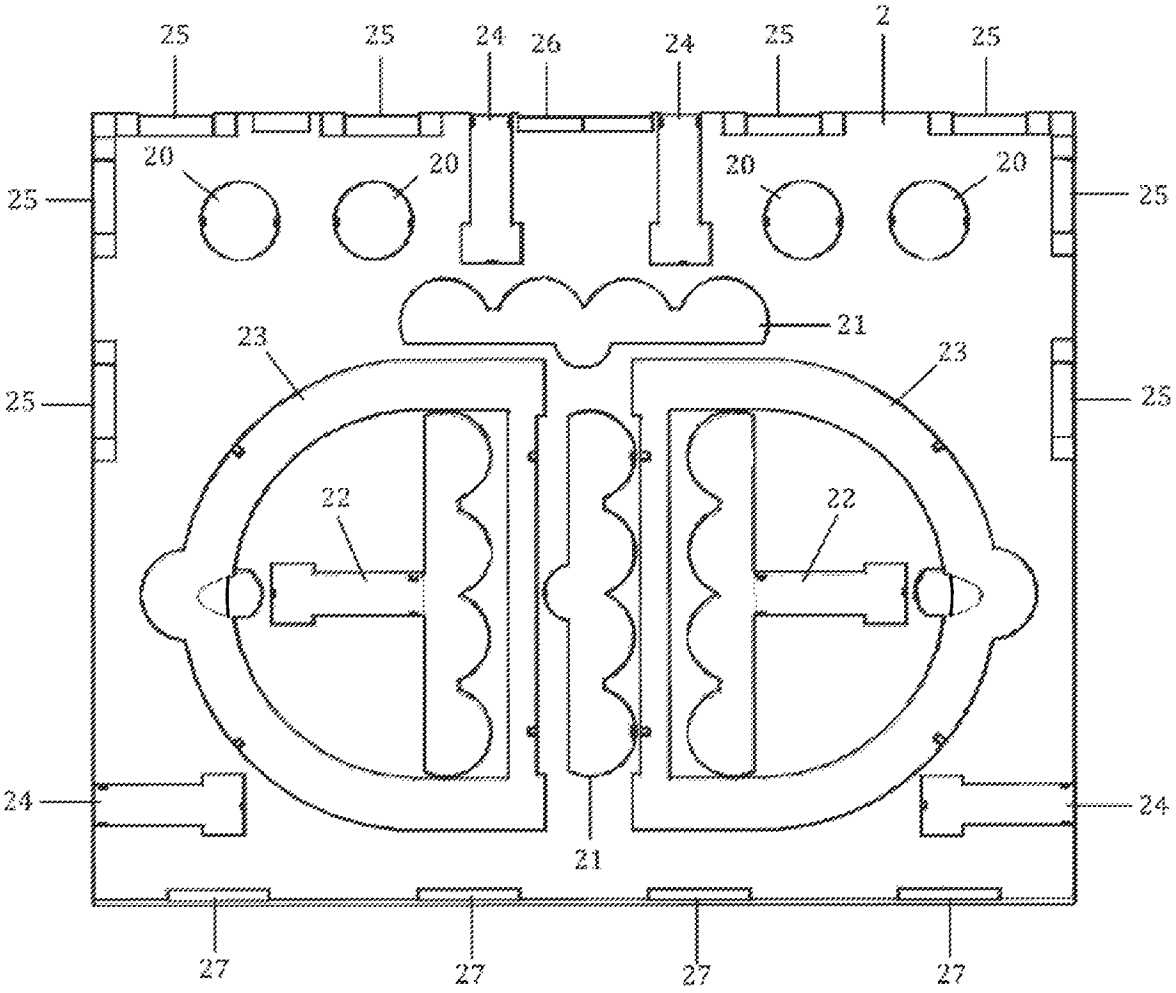
FIG. 3 illustrates a bottom view of an example upper assembly.
Figure 4:
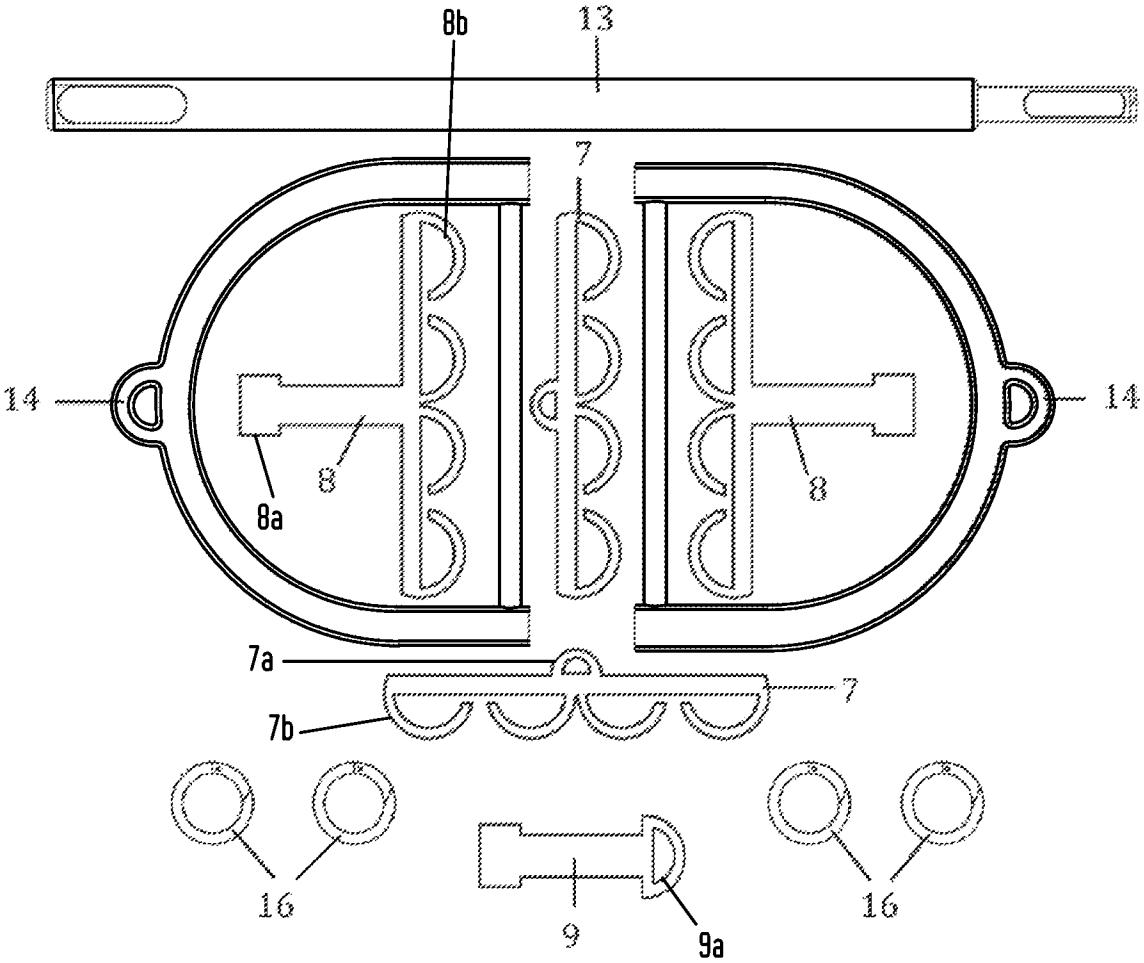
FIG. 4 illustrates example exercise apparatus accessory devices usable with the exercise apparatus.
Figure 5:
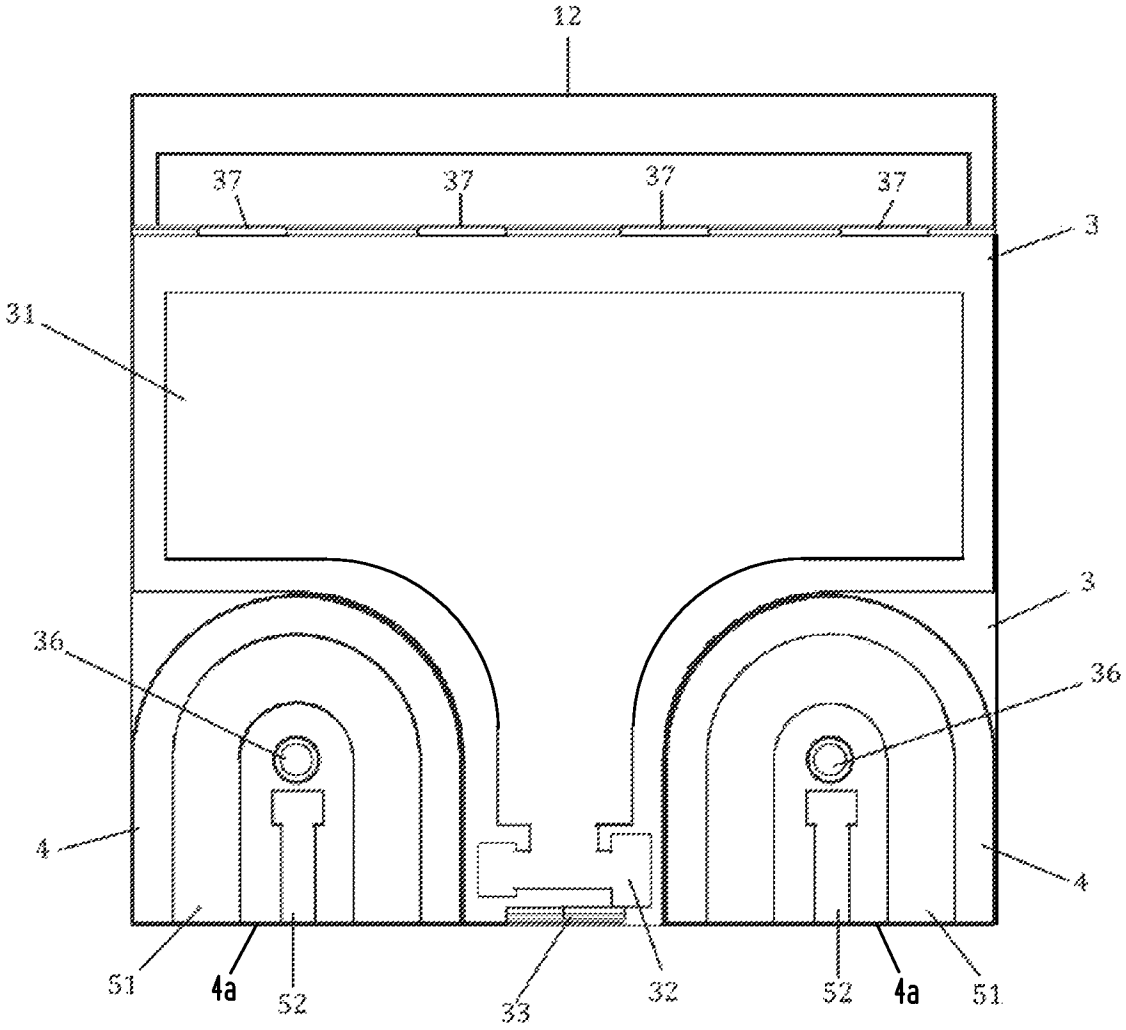
FIG. 5 illustrates a top view of an example lower assembly.

Upper 2 and lower 3 assemblies may be hingedly interconnected by a tongue and groove hinge. It is noted that the examples are not limited to the tongue and groove style hinge. Other examples may include but are not limited to piano or butterfly type hinges. With reference to FIGS. 3-5, four slots or grooves 27 located at the rear of upper assembly 2 (FIG. 3) are configured to mate with four extrusions or tongues 37 located near the rear of the lower assembly 3 (FIG. 5). A connecting rod 34 (FIG. 2) may be inserted through predrilled holes at the base of each of the upper 2 and lower 3 assemblies allowing the exercise apparatus to open and close when the upper 2 and lower 3 assemblies pivot relative to one another. Connecting rod 34 may be formed of any of a variety of materials including but not limited to a metal or composite material.

FIG. 1 illustrates an example closed configuration of the exercise apparatus while FIG. 2 illustrates an example open configuration. In an example, upper assembly 2 may be capable of pivoting beyond the position depicted in FIG. 2, for example to a position in which an angle of 180 degrees is formed between the upper 2 and lower 3 assemblies.

As illustrated by way of example in FIGS. 1-3, 5 and 10, a slide lock 5. It is noted that the examples are not limited to the slide lock, and other examples are also contemplated. The slide lock for use with an example exercise apparatus may include an L-shaped upper locking mechanism 26 provided near the front of upper assembly 2 (FIGS. 1, 2 and 10), a T-shaped lower locking mechanism 33 provided near the front of the lower assembly 3 and a T-shaped latch 5 for slidable receipt upon upper 26 and lower 33 locking mechanisms.

Figure 10:
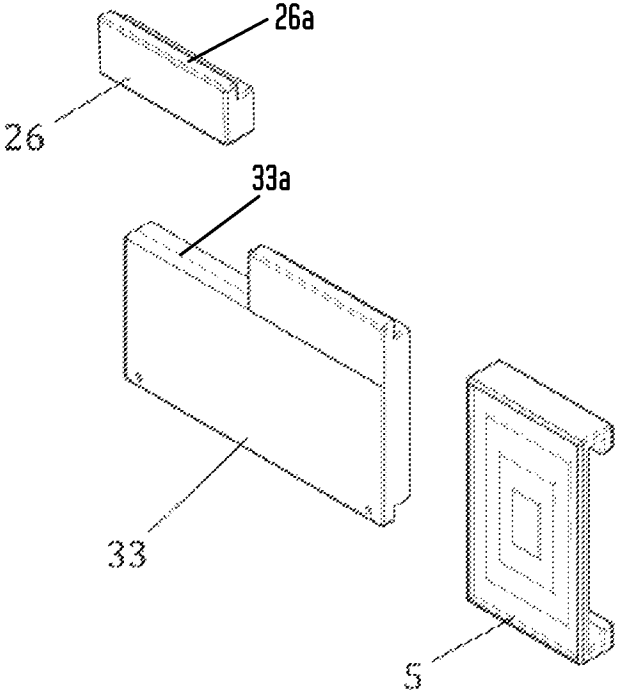
FIG. 10 illustrates an exploded view of an example exercise apparatus locking mechanism.

When an exercise apparatus is in a closed position, as shown by way of example in FIG. 1, upper locking mechanism 26 mates with the notch 33*a* on the top left side of the lower locking mechanism 33 (FIG. 10). Latch 5 may slide along the lower locking mechanism 33 in either left or right directions. When the latch 5 slides to the right of the lower locking mechanism 33, tab 26*a* of upper locking mechanism 26 is not engaged by latch 5 allowing relative pivoting of upper 2 and lower 3 assemblies. When the latch 5 slides to the left of the lower locking mechanism 33, tab 26*a* is engaged by latch 5, locking the exercise apparatus and preventing the upper 2 and lower 3 assemblies from relative pivoting.

Figure 17:
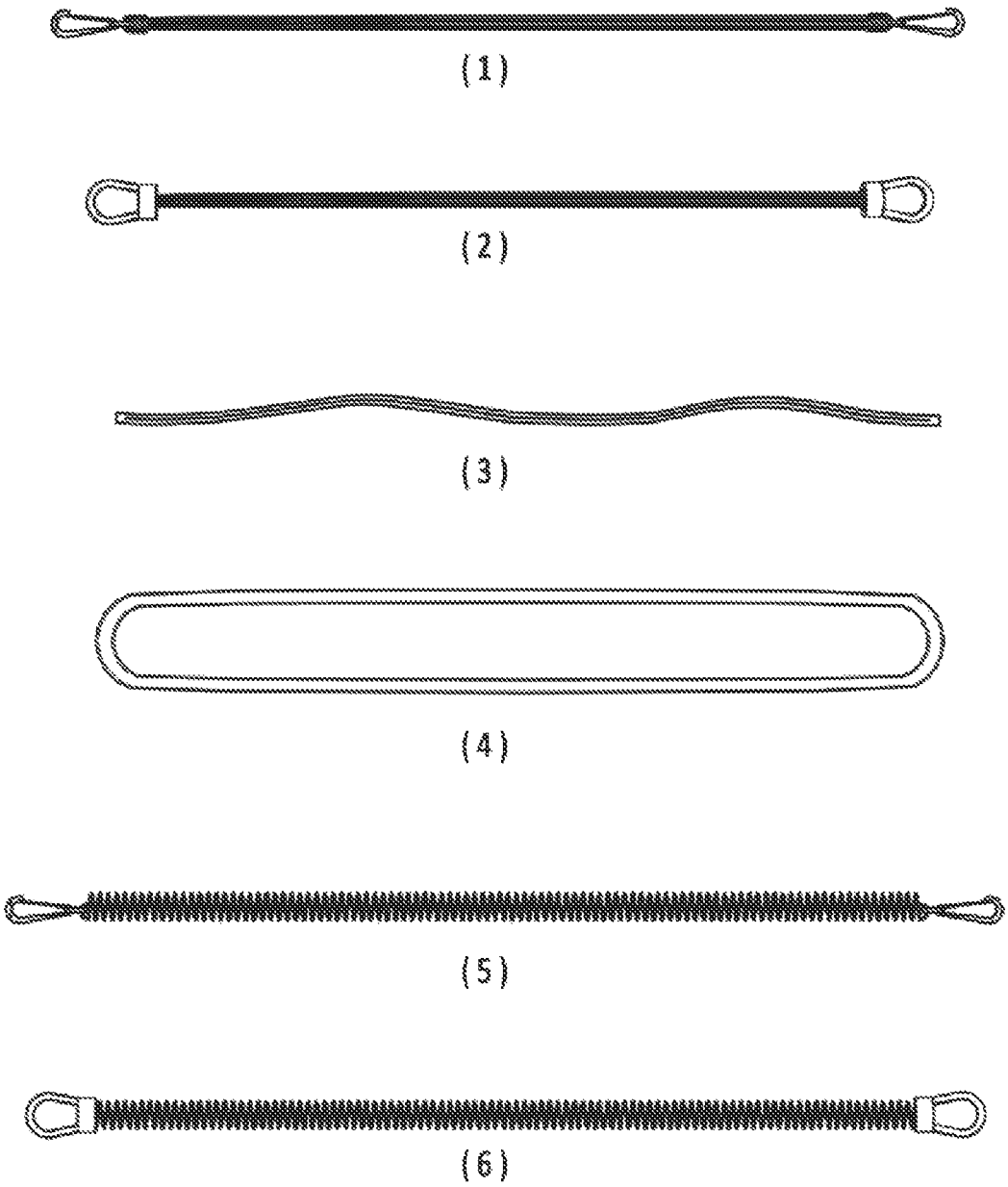
FIG. 17 illustrates example resistance media available usable with the exercise apparatus.

As illustrated in FIGS. 2 and 5 lower assembly 3 may be a multi-functional assembly comprising two rotary discs 4 positioned to either side of lower assembly 3 over spindles 36. U-grooves 51 and T-channels 52 of rotary discs 4 may be used to secure resistance bands or tension springs FIG. 17 to the lower assembly 3. Spindles 36 are configured to enable each rotary disc 4 to rotate within a plane perpendicular to spindles 36 independently of the opposing disc. Thus, a user may change the orientation of the resistance media held by rotary discs 4. Rotary discs 4 thereby offer versatility by facilitating transitions between exercise positions. In an example, rotary discs may be D-shaped.

In an example, rotary discs 4 are capable of 90 degrees of rotation, for example, between positions with spine 4*a* (FIG. 5) of the 'D' towards the upper 2 and lower 3 assembly fronts and positions with the spine 4*a* of the 'D' towards the upper and lower assembly sides. In an example, rotary discs 4 may be capable of different degrees of rotation.

With U-grooves 51 and T-channels 52, each rotary disc 4 can accommodate a variety of the most common types of resistance media including but not limited to linear open end or circular closed loop resistance bands and metal tension springs. Some of these resistance media are depicted by way of example in FIG. 17.

Figure 6:
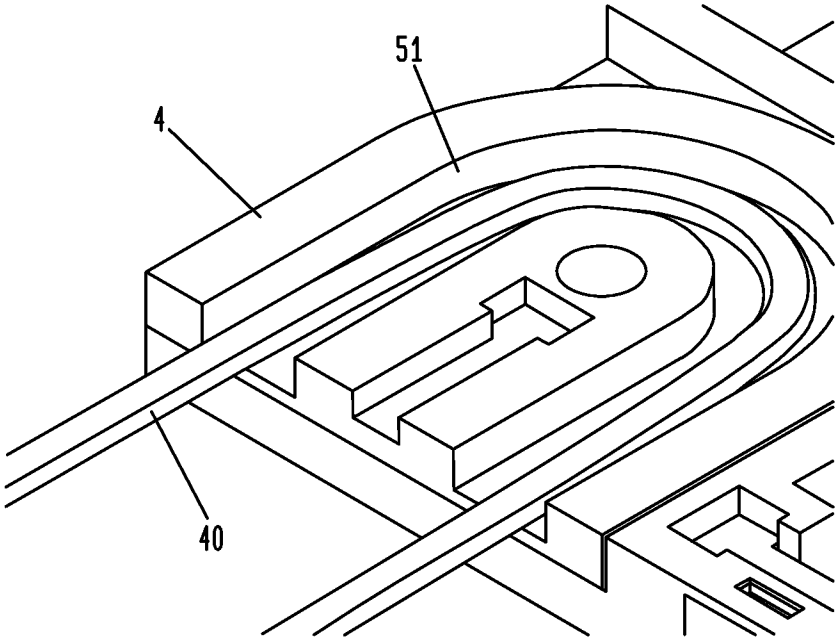
FIG. 6 illustrates an example rotary disc having a closed loop resistance band inserted in a U-groove.

In an example use of rotary discs 4, closed loop resistance bands may be accommodated within U-grooves 51 (FIG. 6) located on the front and each side of the lower assembly 3. Resistance bands of various sizes and resistance levels may be inserted into the U-grooves 51. In an example, the upper surface of rotary discs 4 mate with the inner surface of the upper assembly 2 such that U-grooves 51 are effectively closed into curved lumens when the upper assembly 2 (FIG. 28) is in the closed locked position. In this position, exercise media threaded into U-grooves 51 are locked into the exercise apparatus.

T-channels 52 (FIG. 5) allow for connection of linear open end resistance bands by use of T-channel adapters 9, described below.

An example of lower assembly 3 includes a storage compartment 32 which may be used to store, for example, T-channel adapters 9. Furthermore, an example may include a storage compartment 31 which may be used to store, for example, a variety of resistance media such as that depicted by way of example in FIG. 17.

Figure 9:
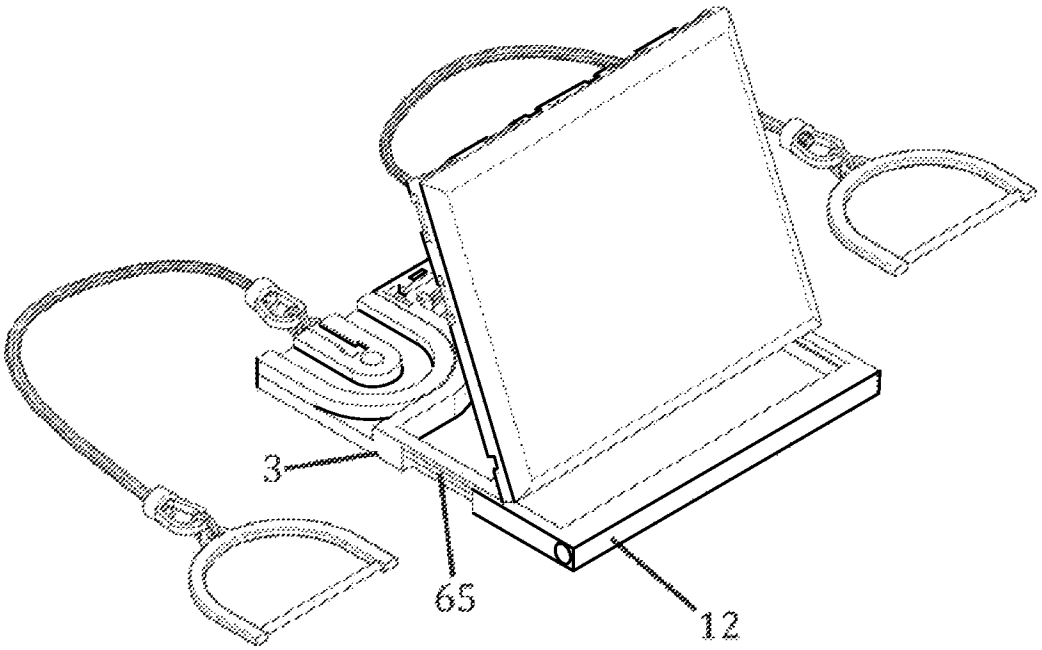
FIG. 9 illustrates a rear view of the exercise apparatus with handle extended.

In an example, lower assembly 3 may be provided with a handle 12 as a convenient means for holding the exercise apparatus during transport from one location to another. Handle 12 may be secured to lower assembly 3 (FIG. 9) by mounting rails 65 (FIG. 9) positioned at the sides of the lower assembly 3. In addition to being configured for securing handle 12 to lower assembly 3, mounting rails 65 (FIG. 9) are configured to allow handle 12 to move between extended and retracted positions relative to the front of upper 2 and lower 3 assemblies. The handle 12 may be placed in the retracted position, as demonstrated in FIG. 1, while the exercise apparatus is in use or prepared for storage.

Figure 11:
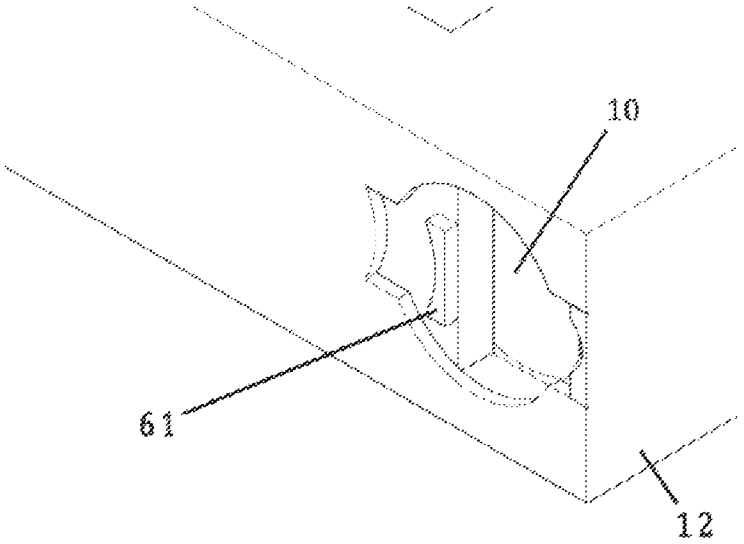
FIG. 11 illustrates an example handle detailing a handle door and storage compartment.

In an example, handle 12 further comprises an accessory storage compartment 10 (FIG. 11) configured to store, for example, an exercise bar 13 (described below). Handle door 61 may be used to secure exercise bar 13 in storage compartment 10. Handle door 61 moves between up (closed) and down (open) positions relative to the top of handle 12. With door 61 is in the open position, storage compartment 10 is exposed allowing for insertion or removal of an item such as exercise bar 13. When handle door 61 is in the closed position, storage compartment 10 is covered allowing the exercise bar 13 to be securely stored.

As illustrated in FIGS. 1-3 upper assembly 2 may be multi-functional and comprise eight glide rollers 25. In an example, four guide rollers 25 may be provided at the front and two on each side of upper assembly 2. Glide roller assemblies 25 are configured to spin around axes parallel to the outer surface of upper assembly 2 to reduce friction exerted on resistance media 1, 2, 3 and 4 (FIG. 17) held within U-grooves 51 thereby increasing the life of the resistance media.

Glide rollers 25 are positioned to align with U-grooves 51 when upper 2 and lower 3 assemblies are closed (FIG. 1). While a rotary disc 4 is positioned at 0 degrees in relation to the front of the exercise apparatus, the U-grooves 51 align with the four front glide rollers 25 as seen in FIG. 1. When a disc 4 is positioned at 90 degrees in relation to the front of the exercise apparatus, U-grooves 51 align with the glide rollers 25 common to its respective side.

During an example use of an exercise device including rollers 25 (FIGS. 18-27), as exercise media such as resistance band 40 (FIG. 6) moves over glide roller assemblies 25 assemblies 25 turn in a direction opposing the stress being applied to the media.

For example, if a resistance band is being pulled and stress applied in an upward direction in relation to the exercise apparatus, glide rollers 25 engaged by the resistance band turn in a counter clockwise direction. When tension is released and the band retracts rollers 25 turns in a clockwise direction reducing the friction between the band and exercise apparatus.

Glide rollers 25 may be made of a variety of lightweight, high strength materials including but not limited to metal, metal alloy, plastic or ceramic.

When locked in a closed position as shown by example in FIG. 1, upper assembly 2 prevents resistance media threaded into U-grooves 51 (FIG. 6) from coming out of the channels by closing off the top of the U-grooves 51. Upper assembly 2 also serves to secure adapters coupled with T-channels 52 (FIG. 7) by closing off the top of the T-channel, when the exercise apparatus is locked in the closed position. It is noted that the terms "U" and "T" designate example configurations and other configurations are also possible as will be understood by those having ordinary skill in the art after becoming familiar with the teachings herein.

In an example, upper assembly 2 may be provided with accessory storage compartments 20, 21, 22 and 23. Compartments may be used to store a variety of accessories. For example, storage compartments 20 may be used to store carabineers 16 (FIG. 4), storage compartments 21 and 22 may be used to store multi-band adapters 7 and 8 (FIG. 4) and storage compartments 23 may be used to store hand bars 14 (FIG. 4). Upper assembly 2 may serve to safeguard resistance media and accessories stored in storage compartments 20, 21, 22, 23, 31 and 32 when the latch 5 locks upper 2 and lower 3 assemblies against pivoting.

Furthermore, the T-channels 24 may be provided on the front and sides of upper assembly 2 to enable attachment of accessories using T-channel adapters 9.

The exercise apparatus is configured to enable use with a variety of exercise apparatus accessory devices. Accessory devices may include but are not limited to hand bars 14, hand pads 17, linear resistance bands 40 with closed loop connectors 41, carabineers 16, exercise bar 13, and T-channel adapters 9.

Through use of the accessory devices, users may quickly change apparatuses as well as resistance levels to perform a variety of different exercises. Accessory devices may be constructed of any of a variety of non-corrosive, light weight materials including but not limited to metal such as stainless steel or aluminum or plastic. Many exercises accomplished with free weights or more popular stationary apparatuses may be accomplished through use of the exercise apparatus with accessory devices.

With reference to FIG. 4, a T-channel adapter 9 may be coupled with a carabineer 16 and a rotary disc 4 to enable use of resistance media including closed loop connectors on both ends, for example, resistance bands 2 and metal tension springs 6. In an example assembly, a T-channel adapter 9 is inserted into the T-channels 52 (FIG. 5), a carabineer 16 is coupled between closed loop end 9*a* of T-channel adapter 9 and closed loop connector 41 of the resistance device 40 to secure the media to the exercise apparatus. T-channel adapters 9 may also be used to attach an optional harness (FIG. 12) enabling wearing of the exercise apparatus as a backpack and accommodating a variety of upper body exercises. As mentioned above, T-channel adapters 9 may be stored in storage compartment 32 when not in use.

With multi-band adapters 7 and 8 illustrated by way of example in FIG. 4, many commonly available resistance bands and tension springs types may be used with an example of the disclosed exercise apparatus. In an example, a multi-band adapter comprises a male adapter 8 and a female adapter 7.

Figure 7:
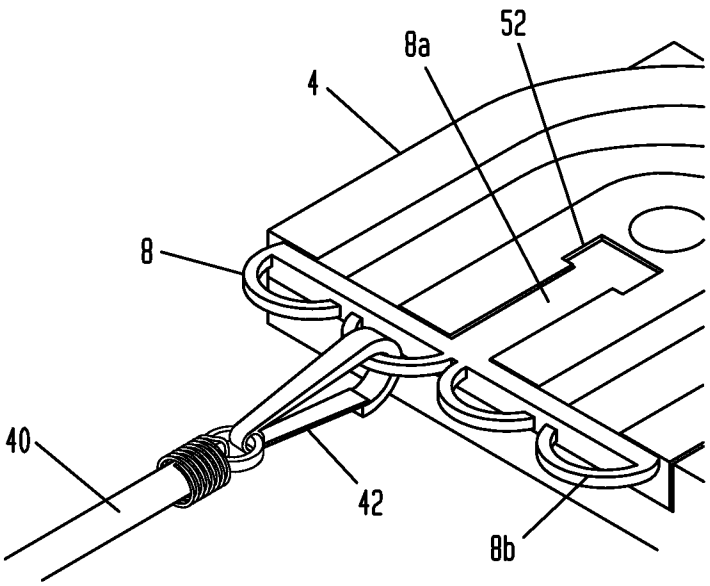
FIG. 7 illustrates an example rotary disc with a male multi-band adapter and resistance device with a hook type connector.

Male adapter 8 is configured to mate with T-channels 52 (FIG. 7). T-channels 52 are configured to receive extension 8*a* of the male adapter 8 (FIG. 7).

A small closed loop 7*a* on top of female adapter 7 may be used to securely attach accessory devices to the exercise apparatus by coupling carabineer 16 to closed loop connector 7*a* at the top of the female adapter 7.

Figure 16:
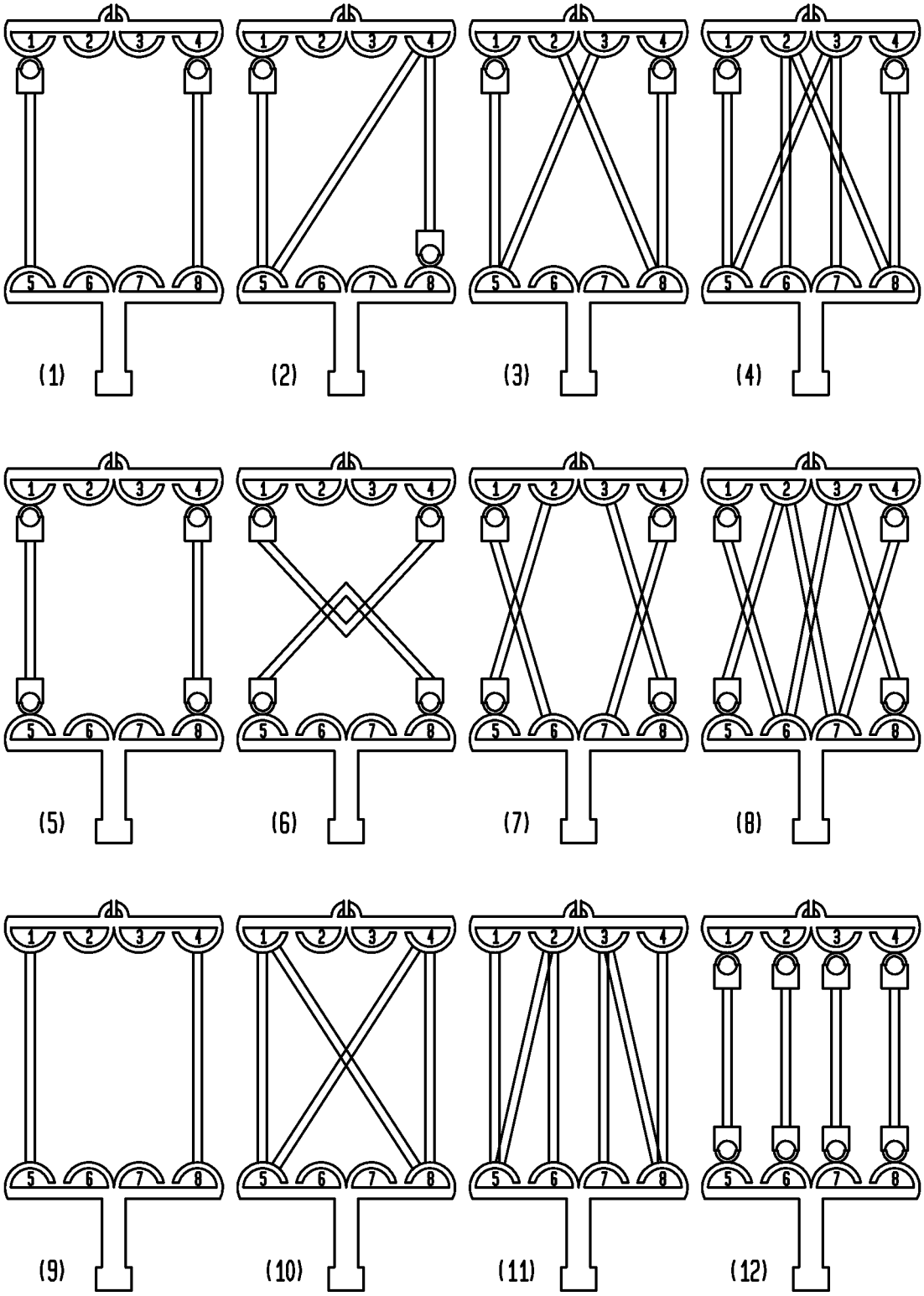
FIG. 16 illustrates example variable resistance level configurations using the multi-band adapters.

The open loops 8*b* and 7*b* on the bottom of the male 8 and female 7 adapters are used to facilitate a variety of resistance levels. FIG. 16 illustrates a variety of possible configurations for resistance media held by open loops 8*b* and 7*b*.

Resistance media having hook connectors, such as resistances bands 1 and tension springs 5, (FIG. 17) may be secured to male 8 or female 7 multi-band adapter eyelets by clipping hook 42 (FIG. 7) to one of the four eyelets 8*b* or 7*b* located at the bottom of the male adapter 8 or female adapter 7.

Figure 14:
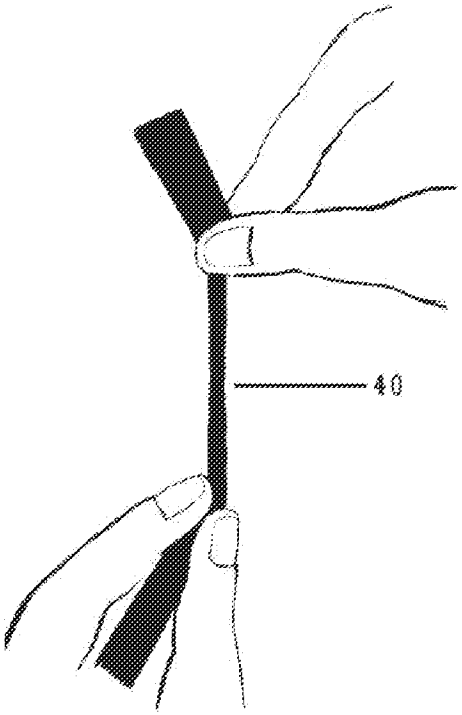
FIG. 14 illustrates example resistance media preparation for use with multi-band adapters.

Resistance media having closed loop connectors, such as circular closed loop resistance bands 4 and linear resistance devices 2 and 6 (FIG. 17) may be secured to the male and female multi-band adapters by pinching the resistance media 40 between the thumb and index finger with hands approximately one inch apart while moving the hands apart (FIG. 14). As the hands move apart the diameter of the elastic band between the fingers begins to narrow. When the diameter of media 40 is smaller than the adapters eyelet opening the narrow portion of the media may be inserted through the desired eyelet opening 8*b* or 7*b* and the resistance media may be released. Upon release, the diameter of resistance band 40 increases to a size larger than the opening of the eyelet. The resistance band may thereby be secured during exercise. To remove or reposition resistance media 40 these steps may simply be reversed for each corresponding eyelet.

Linear flat resistance bands 3 (FIG. 17) may be tied together at both ends to create a closed loop configuration. Male 7 and female 8 adapters, when used with common resistance media such as resistance bands and tension springs, allow users to quickly change resistance levels in a variety of configurations as illustrated in (FIG. 16). Illustrations 1 thru 4 (FIG. 16) depict configurations of a single linear resistance band offering a corresponding variety of resistance levels. Illustrations 5 thru 8 (FIG. 16) depict configurations of two linear resistance bands offering a variety of resistance levels. Illustrations 9 thru 11 of (FIG.

16) depict configurations of closed loop and flat resistance bands corresponding with variable resistance levels.

An exercise bar 13, configured to simulate a barbell frequently used with free weights may be a fixed length or telescoping variable length bar allowing the exercise apparatus to replicate many exercises typically performed with free weights or on more popular stationary apparatuses.

Hand bars 14 configured to simulate dumbbells used with free weights may be used individually or in pairs, with one in each hand. As with exercise bar 13, hand bars 14 allow users to replicate many exercises typically performed with free weights or on more popular stationary apparatuses.

Figure 13:
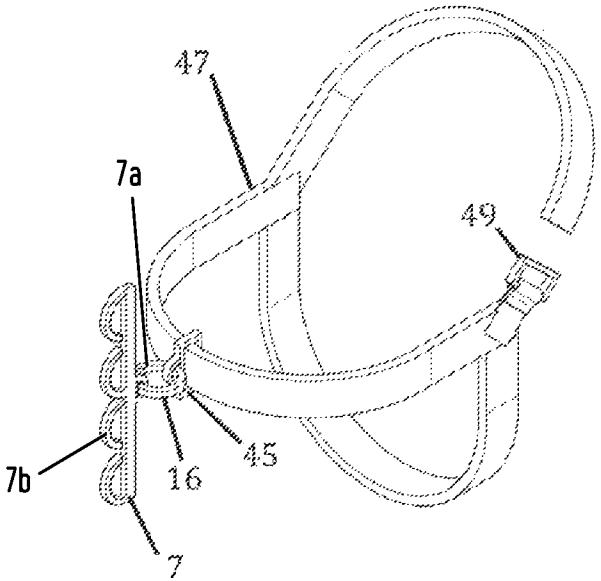
FIG. 13 illustrates an example foot strap with adjustable strap and closed loop connector, connected to a female multi-band adapter.

In an example, the exercise apparatus may also provide hand pads 17 and foot straps (FIG. 13). The hand pads may be formed of densely padded, durable nylon webbing, wrap around the circumference of the horizontal bar at the top of the hand bars 14 to reduce impact of stress or tension exerted on a user's hands while performing exercises.

In an example, foot straps 47 (FIG. 13) may be provided with connectors 45 and 49 which configure to enable securing the device to the foot and provide a means of attaching accessories devices usable with the exercise apparatus. With connector 49, strap 47 may be adjusted for comfort and the foot strap may be secured to a foot of a user for exercise. Connector 45 may be a closed loop connector configured for attaching accessories usable with the exercise apparatus. FIG. 13 demonstrates an example technique of attaching a female multi band adapter 7 to a closed loop connector 45 using carabineer 16 to secure the female adapter 7 to the foot strap. Foot straps may be constructed of any of a variety of materials including but not limited to durable nylon.

Figure 8:
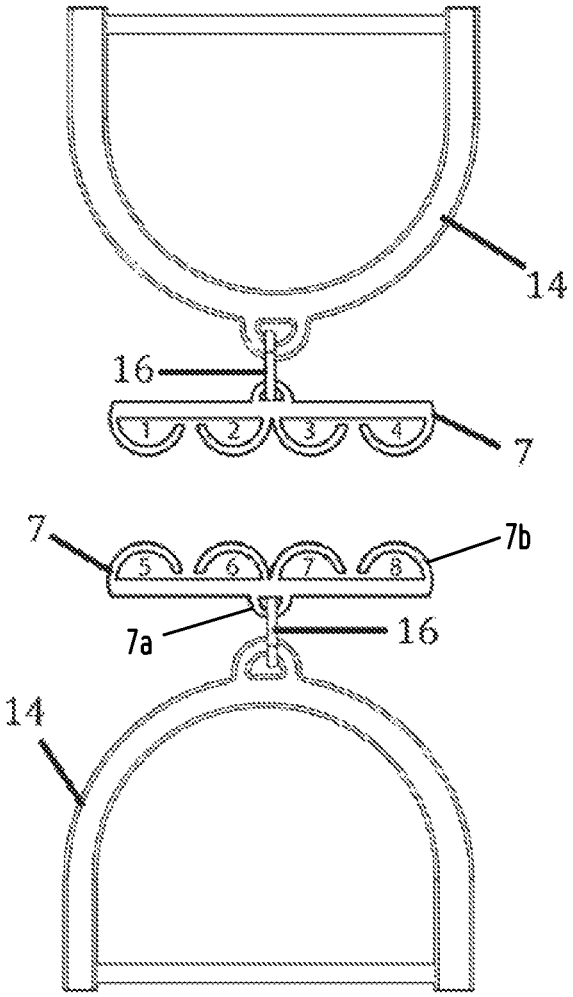
FIG. 8 illustrates example hand bar, carabineer and female adapter connectivity.

The resistance media used in conjunction with each other may be configured to perform a variety of exercises external to the exercise apparatus. As an example, utilizing the two female multi-band adapters 7 in conjunction with two carabineers 16 and two hand bars 14 as shown in FIG. 8, the configuration can simulate a chest expander that when used in conjunction with the resistance devices illustrated in FIG. 17 can be configured as outlined in 1 thru 12 of FIG. 16 independently from the exercise apparatus.

Carabineers 16 may be used to attach resistance media or connectors that are too large to be inserted through the male or female adapter eyelet openings 8*b* and 7*b*. Other examples of the male 8 and female 7 multi-band adapters may be configured with either larger or smaller eyelets or eyelet openings to accommodate larger or smaller resistance bands or connector types.

Figure 12:
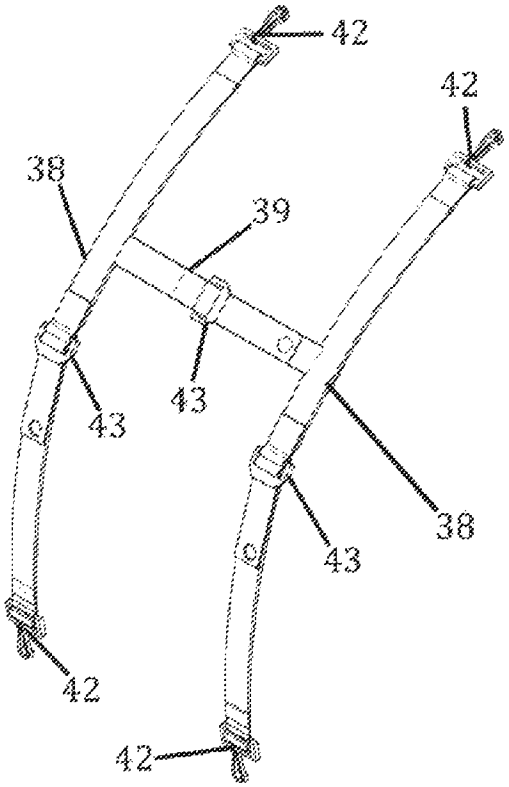
FIG. 12 illustrates an example harness with shoulder straps, chest straps and hook type connectors.
Figure 15:
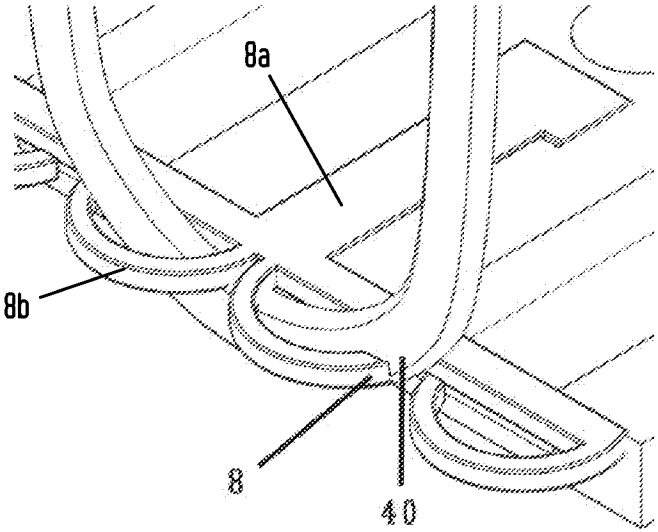
FIG. 15 illustrates example insertion of resistance media into multi-band adapter eyelet openings.

A harness assembly, illustrated by way of example in FIG. 12, may include lightly padded shoulder straps 38 and chest straps 39 for comfort and hook connectors 42 to allow the exercise apparatus to be attached and worn like a backpack. Shoulder straps 38 and chest straps 39 may be adjusted for comfort using slide adjusters 43, thus accommodating users of different size or stature. While wearing the exercise apparatus like a backpack, a user may either sit or stand and perform a variety of exercises such as those depicted in FIGS. 25-27. A harness may be constructed of any of a variety of suitable materials including but not limited to durable nylon.

Figure 28:
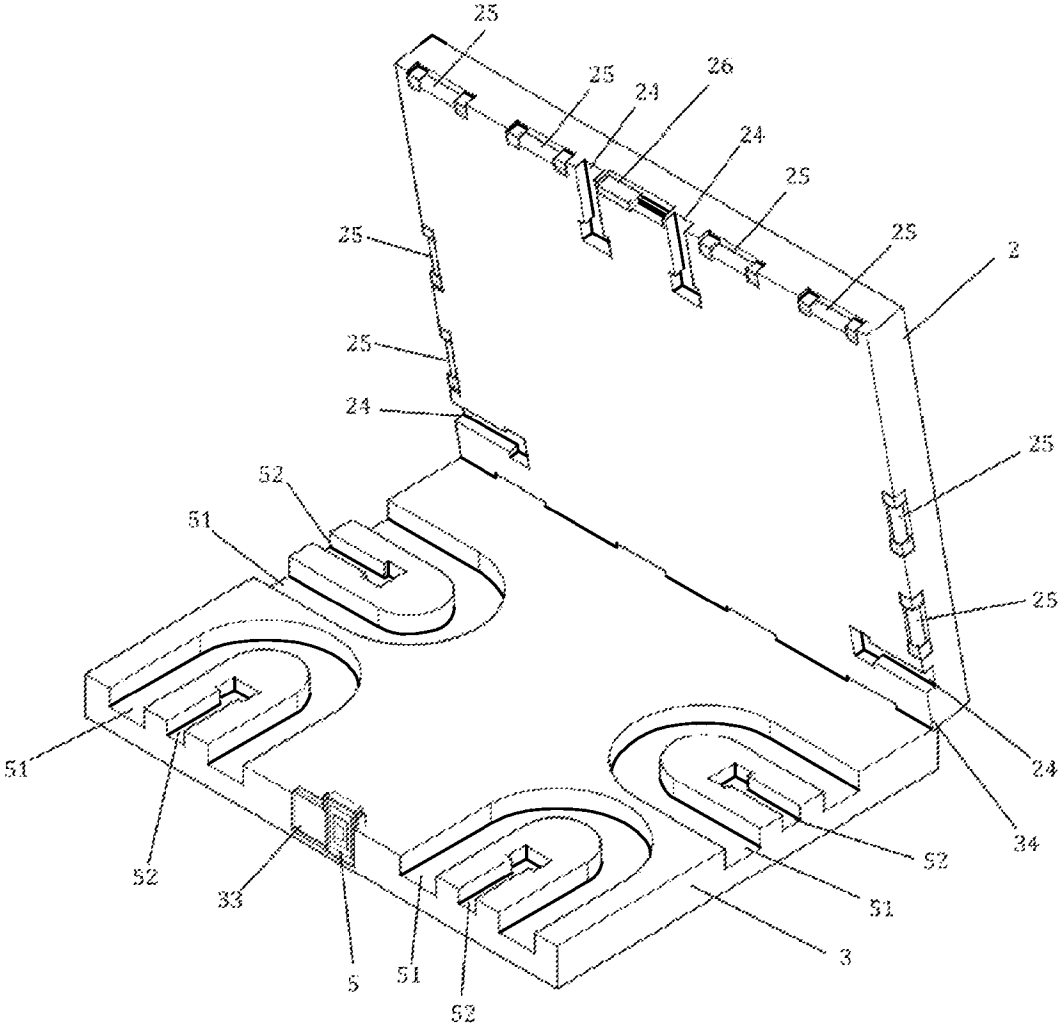
FIG. 28 illustrates an example exercise apparatus with fixed T-channels and U-grooves provided without rotary discs, cushioned top and/or accessory storage compartments.

In an exercise apparatus illustrated by way of example in FIG. 28, rotary discs 4 may be eliminated. Rotary discs 4 may be, for example, replaced by a solid lower platform 3 with U-grooves 51 and T-channels 52 placed at 0, 90, and 270 degrees when viewed from the front of the exercise apparatus. In some examples, U-channels 51 and T-grooves 52 may be provided at angles other than these.

T-channels 52 are configured to offer the same use described with reference to an example including rotary discs 4. In an example provided with a solid platform, a user may unlock the fronts of upper 2 and lower 3 assemblies and pivot the assemblies to open the exercise apparatus before moving exercise media from one U-channel or T-groove to another U-channel or T-groove.

The example exercise device shown in FIG. 28 may be carried like a book or laptop computer. Resistance devices and associated accessories can be stored externally from the apparatus by other means.

Before continuing, it should be noted that the examples described above are provided for purposes of illustration, and are not intended to be limiting. Other devices and/or device configurations may be utilized to carry out the operations described herein.

An exercise apparatus may be prepared for travel or storage by placing the associated resistance media and accessories into designated storage compartments, closing the lid and sliding the latch 5 to the locked position.

In an example, the apparatus may be about the size of a standard laptop computer and may be easily packed in a suitcase, briefcase, carried in a standard laptop bag or transported utilizing a carrying handle incorporated into the apparatus. In an example, the exercise apparatus may also incorporate an optional carrying case or shoulder bag conforming to the contour of the exercise apparatus and including storage compartments to accommodate resistance and accessories devices when not in use.

The operations shown and described herein are provided to illustrate example implementations. It is noted that the operations are not limited to the ordering shown. Still other operations may also be implemented.

Figure 29:
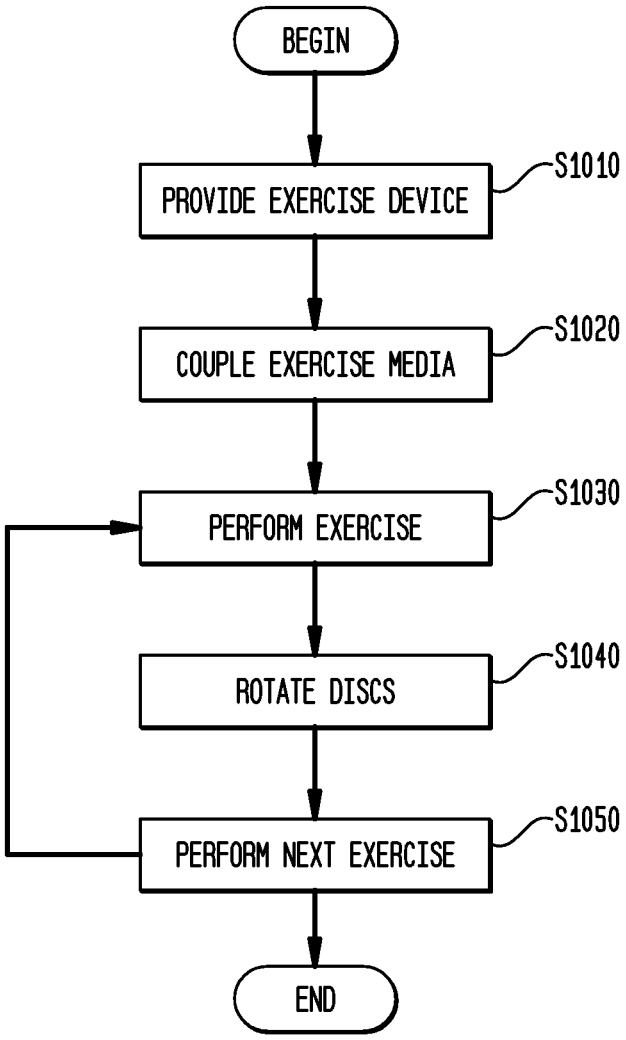
FIG. 29 is a flow diagram illustrating example use of the exercise apparatus

As mentioned, an exercise apparatus may be used to practice a variety of exercises. According to a method of using the apparatus depicted by way of example in FIG. 29, starting with the exercise apparatus in a closed configuration in step S1010, a user desiring to exercise pivots the upper 2 and lower 3 assemblies relative to one another about the axis of connecting rod 34 to reveal U-grooves. An example including a locking mechanism, may require latch 5 be slid to allow for opening of the exercise apparatus.

The user then provides one or more resistance media to the U-grooves in step S1020. In an example including storage compartments within upper 2 and/or lower 3 assemblies, the user may provide the resistance media from the storage compartments. In an example not including rotary discs, the user will choose which sets of U-grooves are appropriate for the exercise he or she would like to perform. For example, the user may select to use the U-grooves on the left and right sides of the exercise apparatus, the U-grooves on the front of the exercise apparatus or a combination of these. After providing the chosen exercise media to the selected U-grooves, the user may close the exercise apparatus to close the top of U-grooves against upper assembly 2.

In an example including rotary discs, the user need not select the orientation of the U-grooves before closing the exercise device since rotary discs are capable of rotation while the upper 2 and lower 3 assemblies are closed. Rotation of rotary discs effectively rotates the U-grooves.

With the exercise media coupled with the U-grooves, the user may perform exercise by pulling the coupled exercise media from a contracted position to a stretched position in step S1030.

Figure 20:
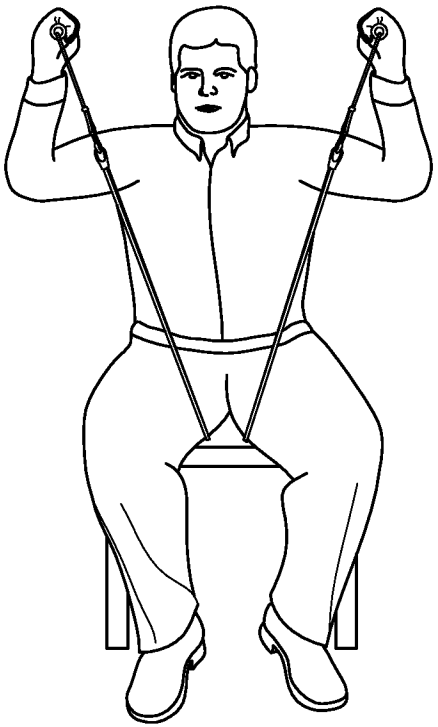
FIG. 18-27 illustrate example methods of using an exercise apparatus in seated, standing and kneeling positions.
Figure 19:
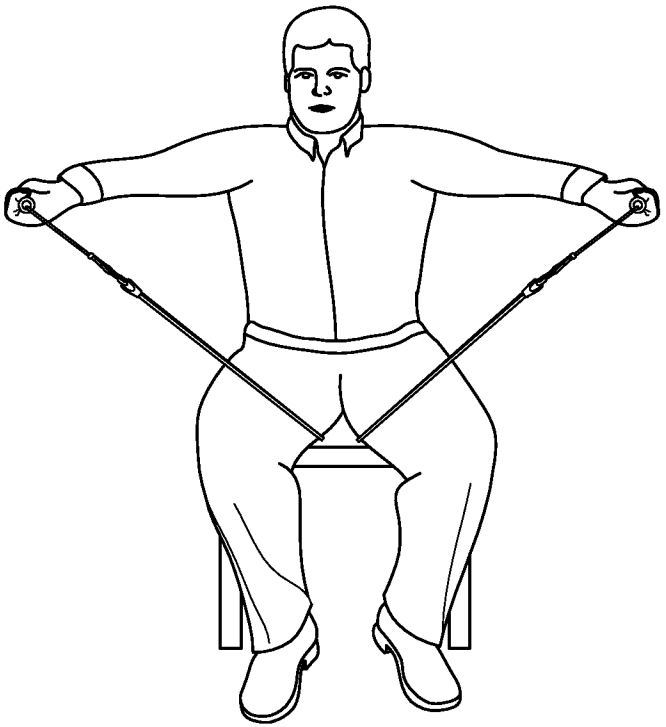
Figure 18:
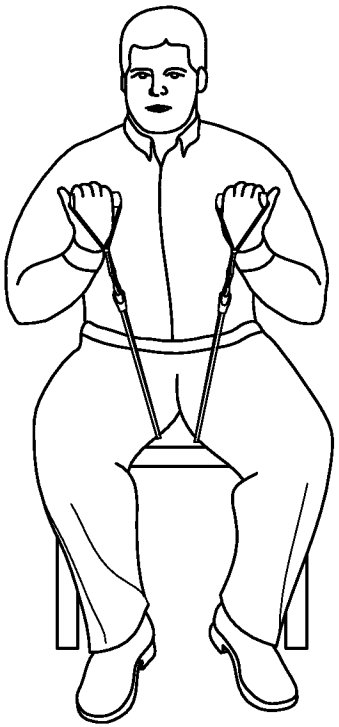

During some exercises the user may be seated on a top surface of the upper assembly while pulling the coupled exercise media from a contracted position to a stretched position. Examples of seated exercises are illustrated in FIGS. 18-20. As shown in FIG. 18, with his or her upper arms approximately parallel with the frontal plane the user flexes his or her arms at the elbows. As shown in FIG. 19, with his or her arms extended at the elbows, the user abducts his or her arms at the shoulders. As shown in FIG. 20, a user may extend his or her arms at the elbows and abduct the two arms at their respective shoulders from a position with hands near ears of a user to a position above the head of the user.

Figure 21:
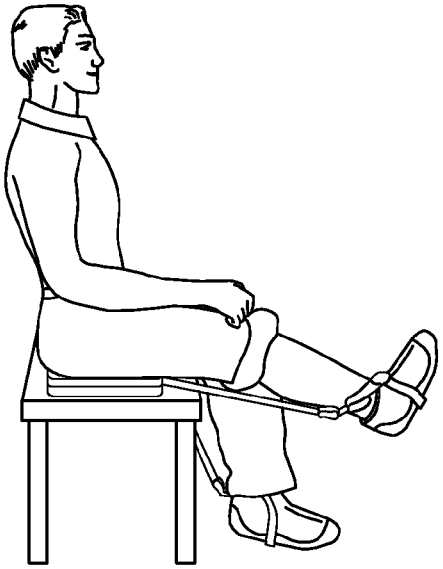

With an example including a foot harness, after coupling the foot harness to his or her foot, a user, while seated, may exercise by flexing one leg at the hip and extending the leg at the knee to pull exercise media from the contracted position to the stretched position as shown in FIG. 21.

Figure 22:
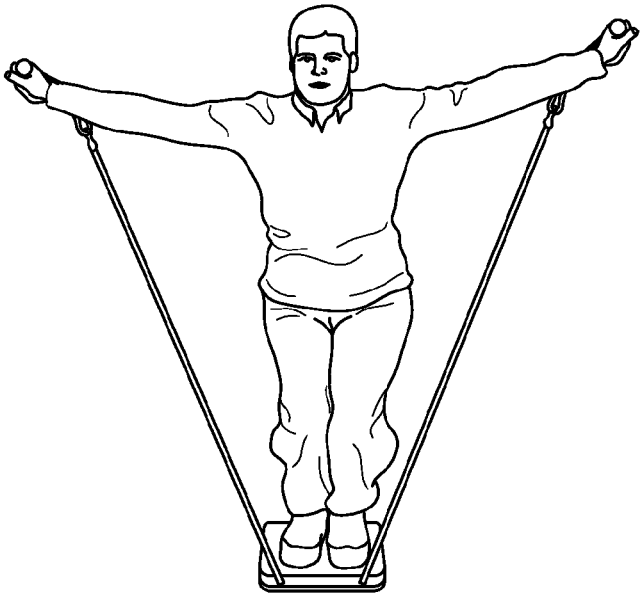
Figure 23:
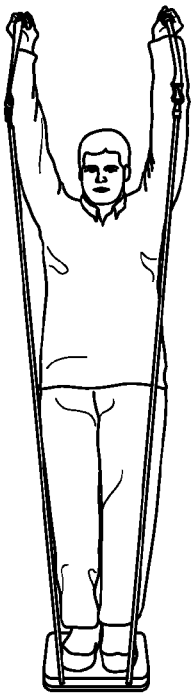
Figure 24:
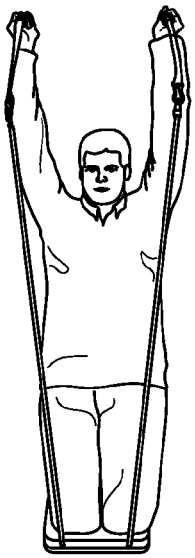

During some exercises, the user may stand on the top surface of upper assembly 2 while pulling the coupled exercise media from a contracted position to a stretched position. Examples of standing exercises are illustrated in FIGS. 22 and 23. As shown in FIG. 22, a user may abduct his or her arms at the shoulders from an approximately vertical position to an approximately horizontal position. As shown in FIG. 23, a user may extend his or her arms at the shoulders approximately 180 degrees from an approximately vertical position. As shown in FIG. 24, from a kneeling position a user may extend his or her arms at their respective elbows and abduct the arms at the shoulders from a position with hands near ears of a user to a position above the head of a user.

Because rotary discs are capable of rotation without opening the exercise device, in an example including the rotary discs, the user may remain seated or standing on the exercise device and adjust the orientation of the rotary discs in step S1040 to perform a different exercise in a step S1050. The user may use this feature to perform a variety of exercises consecutively without opening the upper 2 and lower 3 assemblies.

Figure 27:
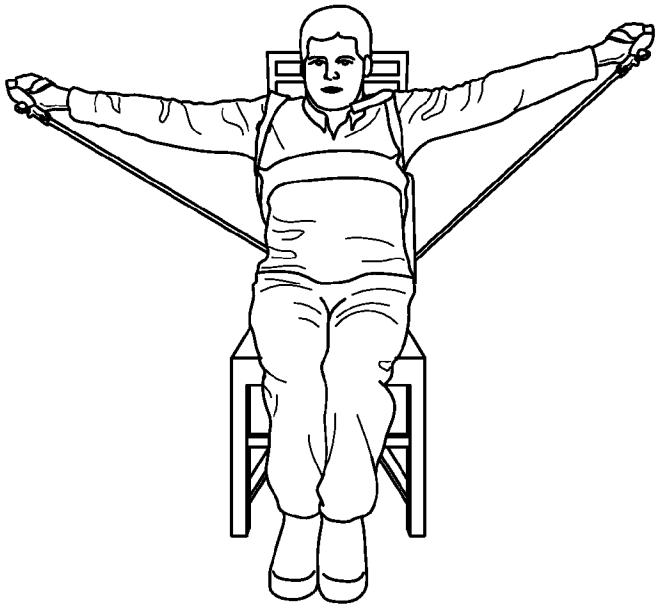
Figure 26:
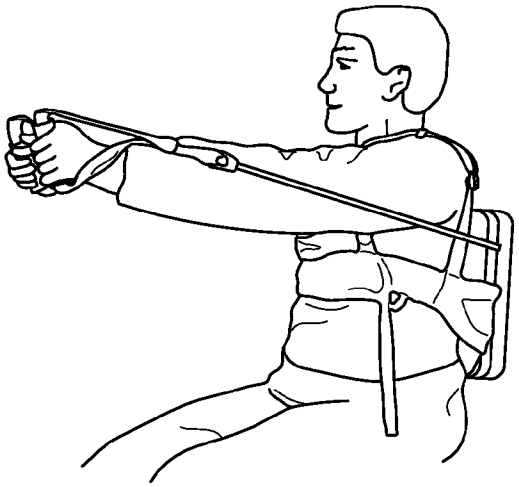
Figure 25:
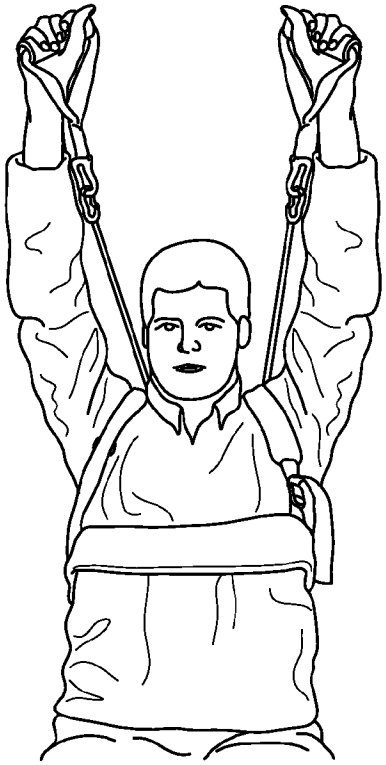

With an example including a harness as shown in FIG. 12, after coupling the harness to upper assembly 2, the user may also couple the harness to his or her torso, using straps 38 and 39 with adjusters 43. As such, the exercise apparatus will be held to the back of the user to allow the user to perform exercises such as those illustrated in FIGS. 25-27. As shown in FIG. 25, with the exercise device worn as a backpack, the user may extend his or her arms at the elbows and abduct his or her arms at the shoulders from a position with hands near ears of a user to a position above the head of a user. As shown in FIG. 26, with the exercise device worn as a backpack and the user's arms flexed within a transverse plane, the user may extend his or her arms at the elbows and rotate his or her arms at the shoulders from a position with hands near the side of the user to a position with hands in a plane shared with the shoulders in front of the user. As shown in FIG. 27, with the exercise device worn as a backpack, the user may move his or her arms from a position within a frontal plane to a position where each arm lies within a parasagittal plane.

It is noted that the exercises for which the present disclosure may be used, are not limited to those explicitly shown or described. Furthermore, the examples shown and described are provided for purposes of illustration and are not intended to be limiting. Still other examples are also contemplated.

The invention claimed is:

1. An exercise apparatus, comprising:

an upper assembly including a front, a rear, two sides and an outer surface;

a lower assembly coupling with the upper assembly and including a front, a rear, two sides and an inner surface;

a plurality of engaging channels provided by the lower assembly at a variety of orientations, at least one of the engaging channels is substantially U-shaped; and a plurality of resistance media for selective coupling with the engaging channels, the plurality of resistance media including at least a male adapter and a female adapter each having a plurality of connections to configure linear resistance bands in a variety of configurations, wherein at least one of the resistance media is threaded into a first end of the at least one U-shaped engaging channel through the entire U-shaped engaging channel and out of a second end of the at least one U-shaped engaging channel.

2. The exercise apparatus of claim 1, wherein the upper assembly further comprises a plurality of glide rollers provided near the upper assembly front and two sides, the glide rollers spin around axes parallel to the upper assembly outer surface to reduce friction of the resistance media.

3. The exercise apparatus of claim 1, wherein the engaging channels further comprise:

T-channels for engagement with a T-channel adapter; and

U-channels for engagement with the resistance media.

4. The exercise apparatus of claim 1, wherein the upper assembly further comprises:

male adapters including a T-channel adapter and at least one open loop; and female adapters including a closed loop and at least one open loop.

5. The exercise apparatus of claim 1, further comprising at least one rotary disc coupled to the lower assembly by a spindle to allow for rotation of the rotary disc within a plane perpendicular to the spindle, and wherein the engaging channels are provided in a surface of the at least one rotary disc.

6. The exercise apparatus of claim 5, wherein the at least one rotary disc rotates through an angle of approximately 90 degrees from an orientation wherein ends of the engaging channels are directed towards one of the two sides of the lower assembly to an orientation wherein ends of the engaging channels are directed towards the front of the lower assembly.

7. The exercise apparatus of claim 5, wherein the at least one rotary disc comprises at least two rotary discs and wherein one rotary disc is provided near a corner formed by the front and one of the two sides of the lower assembly and the other rotary disc is provided near a corner formed by the front and the other one of the two sides of the lower assembly.

8. The exercise apparatus of claim 1, wherein the plurality of resistance media include resistance bands and tension springs.

9. The exercise apparatus of claim 1, further comprising two or more hand grips to couple with the plurality of resistance media.

10. The exercise apparatus of claim 1, wherein the lower assembly further comprises a carrying handle used to transport the exercise apparatus.

11. The exercise apparatus of claim 1, further comprising an exercise bar.

12. The exercise apparatus of claim 1, wherein the upper and lower assemblies are interconnected by a hinge for relative pivoting between a closed position wherein the upper assembly outer surface and the lower assembly inner surface are parallel and an open position wherein the upper assembly outer surface and the lower assembly inner surface are angled relative to one another.

13. A method comprising:

providing an exercise apparatus including pivotably connected upper and lower assemblies, a plurality of substantially U-shaped rotary discs pivotally mounted to the lower assembly to rotate about 90 degrees between a first edge of the lower assembly and a second perpendicular edge of the lower assembly, and a plurality of exercise media, the plurality of exercise media including at least a male adapter and a female adapter each having a plurality of connections to configure linear resistance bands in a variety of configurations;

coupling one or more of the plurality of exercise media with the one or more of the plurality of rotary discs;

in response to a user performing at least one first exercise, stretching the coupled exercise media from a contracted position to a stretched position;

rotating the at least one rotary disc to enable performing at least one second exercise.

14. The method of claim 13, wherein stretching the coupled exercise media from a contracted position to a stretched position further comprises enabling the user with two upper arms approximately parallel with the frontal plane to flex the two arms at their respective elbows.

15. The method of claim 13, wherein stretching the coupled exercise media from a contracted position to a stretched position further comprises enabling the user with two arms extended at their elbows abduct the two arms at their respective shoulders.

16. The method of claim 13, wherein stretching the coupled exercise media from a contracted position to a stretched position further comprises enabling the user to extend two arms at their respective elbows and abduct the two arms at their respective shoulders from a position with hands near ears of a user to a position above the head of the user.

17. The method of claim 13, wherein stretching the coupled exercise media from a contracted position to a stretched position further comprises:

operatively coupling a foot harness to the foot of the user to enable the user to flex one leg at the hip and extend the leg at the knee to the coupled exercise media from the contracted position to the stretched position.

18. The method of claim 13, further comprising positioning a strap vest around the chest and shoulders of the user such that the upper assembly is held in contact with the back of the user.

19. An exercise apparatus, comprising:

an upper assembly including a front, a rear, two sides and an outer surface;

a lower assembly for assembly with the upper assembly and including a front, a rear, two sides and an inner surface;

a plurality of substantially U-shaped rotary discs pivotally mounted to the lower assembly to rotate in a first configuration about 90 degrees between a first edge of the lower assembly and a second perpendicular edge of the lower assembly, the U-shaped rotary discs held stationary in a second configuration, wherein the U-shaped rotary discs each having a substantially U-shaped engaging channel;

a plurality of resistance media for selective coupling with the substantially U-shaped engaging channels, the plurality of resistance media including at least a male adapter and a female adapter each having a plurality of connections to configure linear resistance bands in a variety of configurations, wherein at least one of the resistance media is threaded into a first end of the at least one U-shaped engaging channel through the entire U-shaped engaging channel and out of a second end of the at least one U-shaped engaging channel; and means for enabling selective coupling of the plurality of resistance media to the lower assembly at a variety of orientations.

20. The exercise apparatus of claim 19, further comprising means for reducing friction to the plurality of resistance media during use of the media to perform one or more exercises.

* * * * *